US008399392B2

(12) United States Patent
Bertram et al.

(10) Patent No.: US 8,399,392 B2
(45) Date of Patent: Mar. 19, 2013

(54) METHOD OF REDUCING ASPHALTENE PRECIPITATION IN AN ENGINE UTILIZING A C22 HYDROCARBYL SALICYLATE

(75) Inventors: Richard D. Bertram, Witney (GB); Peter J. Dowding, Wantage (GB); Peter D. Watts, Abingdon (GB)

(73) Assignee: Infineum International Limited (GB)

( * ) Notice: Subject to any disclaimer, the term of this patent is extended or adjusted under 35 U.S.C. 154(b) by 0 days.

(21) Appl. No.: 12/557,003

(22) Filed: Sep. 10, 2009

(65) Prior Publication Data

US 2010/0062957 A1 Mar. 11, 2010

(30) Foreign Application Priority Data

Sep. 11, 2008 (EP) ..... 08105317

(51) Int. Cl.
*C11D 7/26* (2006.01)

(52) U.S. Cl. ..... 510/185; 508/502; 508/518; 508/522; 508/583; 508/584; 560/143

(58) Field of Classification Search ..... 510/185; 508/502, 518, 522, 583, 584; 562/473; 560/143
See application file for complete search history.

(56) References Cited

U.S. PATENT DOCUMENTS 3,985,687 A * 10/1976 Inamorato et al. ..... 510/325
4,021,359 A * 5/1977 Schwab ..... 510/477
4,719,023 A * 1/1988 MacPhail et al. ..... 508/460
2002/0058593 A1* 5/2002 Bovington et al. ..... 508/192
2002/0142922 A1* 10/2002 Yagishita et al. ..... 508/374
2003/0166481 A1* 9/2003 Smith et al. ..... 510/155
2004/0009882 A1* 1/2004 Elsik et al. ..... 510/108
2004/0186027 A1* 9/2004 Moreton et al. ..... 508/186
2005/0137100 A1* 6/2005 Le Coent et al. ..... 508/518
2006/0063686 A1* 3/2006 Yagishita ..... 508/518
2006/0178278 A1* 8/2006 Kocsis et al. ..... 508/390
2006/0281642 A1* 12/2006 Colbourne et al. ..... 508/192
2007/0027057 A1* 2/2007 Le Coent et al. ..... 510/505
2007/0049508 A1* 3/2007 Stonebraker et al. ..... 508/586
2007/0117726 A1* 5/2007 Cartwright ..... 508/525
2008/0026971 A1* 1/2008 Deckman et al. ..... 508/525
2008/0110799 A1* 5/2008 Matsui et al. ..... 208/19
2008/0248981 A1* 10/2008 Matsui et al. ..... 508/382
2008/0255013 A1* 10/2008 Chambard et al. ..... 508/585
2009/0281009 A1* 11/2009 Van Houten ..... 508/287
2010/0069273 A1* 3/2010 Skinner ..... 508/278
2010/0087347 A1* 4/2010 Bertram et al. ..... 508/460
2010/0099591 A1* 4/2010 Harrold et al. ..... 508/502
2010/0197535 A1* 8/2010 Brossaud et al. ..... 508/154

* cited by examiner

*Primary Examiner* — Charles Boyer

(57) ABSTRACT

A method of reducing asphaltene precipitation or 'black paint' in an engine is disclosed. The method includes the step of lubricating the engine with a lubricating oil composition comprising: an oil of lubricating viscosity in a major amount; and, a salicylate detergent system in a minor amount comprising one or more neutral or overbased alkaline earth metal $C_{22}$ hydrocarbyl substituted salicylates.

27 Claims, No Drawings

METHOD OF REDUCING ASPHALTENE PRECIPITATION IN AN ENGINE UTILIZING A C22 HYDROCARBYL SALICYLATE

FIELD OF THE INVENTION

This present invention relates to a method of reducing asphaltene precipitation or 'black paint' in an engine, in particular, a marine diesel engine.

BACKGROUND OF THE INVENTION

In marine trunk piston engines, Heavy Fuel Oil ('HFO') is generally used for offshore running. Heavy Fuel Oil is the heaviest fraction of petroleum distillate and comprises a complex mixture of molecules including up to 15% of asphaltenes, which are defined as the fraction of petroleum distillate which is insoluble in an excess of aliphatic hydrocarbon (e.g. heptane) but which shows solubility in aromatic solvents (e.g. toluene). Asphaltenes can enter the engine lubricant as contaminants either via the cylinder or the fuel pumps and injectors, and asphaltene precipitation can then occur, manifested in 'black paint' or 'black sludge' in the engine. The presence of such carbonaceous deposits on a piston surface can act as an insulating layer, which can result in cracks forming, which then propagate through the piston. If a crack travels right the way through, then hot combustion gases can enter the crankcase, which may result in a crankcase explosion.

A key design feature of trunk piston engine oils ('TPEO's) is prevention of asphaltene precipitation but, with the current use of Group II base oils which have a lower aromatics content, their effectiveness in this respect has been reduced.

WO 96/26995 discloses the use of a hydrocarbyl-substituted phenol to reduce 'black paint' in a diesel engine. WO 96/26996 discloses the use of a demulsifier for water-in-oil emulsions, for example, a polyoxyalkylene polyol, to reduce 'black paint' in diesel engines.

The aim of the present invention is to reduce asphaltene precipitation or 'black paint' in an engine, in particular, a marine diesel engine. The aim of the present invention is also to reduce asphaltene precipitation or 'black paint' in an engine using a lubricating oil composition comprising a Group II basestock.

SUMMARY OF THE INVENTION

The present invention is based on the discovery that the inclusion of one or more neutral or overbased alkaline earth metal $C_{22}$ hydrocarbyl substituted salicylate detergents in an oil of lubricating viscosity comprising a Group II base stock typically improves asphaltene dispersion performance, particularly compared to neutral or overbased alkaline earth metal hydrocarbyl substituted salicylate detergents having a lower hydrocarbyl group (e.g. $C_{10}$ to $C_{18}$ hydrocarbyl substituted salicylates). Additionally, it has been found that a salicylate detergent system consisting essentially of one or more neutral or overbased alkaline earth metal $C_{20}$ to $C_{30}$ hydrocarbyl substituted salicylates which includes one or more of the neutral or overbased alkaline earth metal $C_{22}$ hydrocarbyl substituted salicylates typically improves asphaltene dispersion performance in a Group II base stock compared with a salicylate detergent system consisting essentially of one or more neutral or overbased alkaline earth metal lower hydrocarbyl substituted salicylates e.g. $C_{10}$ to $C_{18}$ hydrocarbyl substituted salicylates.

In accordance with a first aspect, the present invention provides a method of reducing asphaltene precipitation or 'black paint' in an engine, the method including the step of lubricating the engine with a lubricating oil composition comprising, or made by admixing:

(A) an oil of lubricating viscosity in a major amount; and (B) a salicylate detergent system in a minor amount comprising one or more neutral or overbased alkaline earth metal $C_{22}$ hydrocarbyl substituted salicylates; with the proviso that the salicylate detergent system does not include an alkali metal salicylate.

Preferably the oil lubricating viscosity comprises a Group 11 base stock.

The engine is preferably a marine diesel engine, especially a marine trunk piston engine.

The lubricating oil composition is preferably a trunk piston engine oil ('TPEO').

In this specification, the following words and expressions, if and when used, shall have the meanings ascribed below:

"active ingredient" or "(a.i.)" refers to additive material that is not diluent or solvent;

"comprising" or any cognate word specifies the presence of stated features, steps, or integers or components, but does not preclude the presence or addition of one or more other features, steps, integers, components or groups thereof; the expressions "consists of" or "consists essentially of" or cognates may be embraced within "comprises" or cognates, wherein "consists essentially of" permits inclusion of substances not materially affecting the characteristics of the composition to which it applies;

"major amount" means in excess of 50 mass % of a composition;

"minor amount" means less than 50 mass % of a composition;

"TBN" means total base number as measured by ASTM D2896;

"hydrocarbyl" means a chemical group of a compound that contains hydrogen and carbon atoms and that is bonded to the remainder of the compound directly via a carbon atom. The group may contain one or more atoms other than carbon and hydrogen ("hetero atoms") provided they do not affect the essentially hydrocarbyl nature of the group;

"oil-soluble" or "oil-dispersible", or cognate terms, used herein do not necessarily indicate that the compounds or additives are soluble, dissolvable, miscible, or are capable of being suspended in the oil in all proportions. These do mean, however, that they are, for example, soluble or stably dispersible in oil to an extent sufficient to exert their intended effect in the environment in which the oil is employed. Moreover, the additional incorporation of other additives may also permit incorporation of higher levels of a particular additive, if desired;

"salicylate detergent system" refers to that part of the total amount of detergents in the lubricating oil composition which includes solely one or more salicylate detergents. Suitably, the salicylate detergent system may form a part of the total amount of detergents present in the lubricating oil composition (i.e. the lubricating oil composition includes one or more other detergents, for example, metal phenates) or the salicylate detergent system may represent the sole detergent system within the lubricating oil composition (i.e. all of the detergents present in the lubricating oil composition consists solely of the one or more salicylate detergents).

Also, it will be understood that various components used, essential as well as optimal and customary, may react under conditions of formulation, storage or use and that the invention also provides the product obtainable or obtained as a result of any such reaction.

Further, it is understood that any upper and lower quantity, range and ratio limits set forth herein may be independently combined.

DETAILED DESCRIPTION OF THE INVENTION

The features of the invention relating to each and all aspects of the invention will now be described in more detail as follows:

Oil of Lubricating Viscosity (A)

This, sometimes referred to as the base oil or base stock, is the primary liquid constituent of the composition into which additives and possibly other oils are blended.

The lubricating oils may range in viscosity from light distillate mineral oils to heavy lubricating oils such as gasoline engine oils, mineral lubricating oils and heavy duty diesel oils. Generally, the viscosity of the oil ranges from about 2 $mm^2$/sec (centistokes) to about 40 $mm^2$/sec, especially from about 4 $mm^2$/sec to about 20 $mm^2$/sec, as measured at 100° C.

The oil of lubricating viscosity preferably comprises a Group II base stock.

Suitably, the oil of lubricating viscosity comprises greater than or equal to 10 mass %, more preferably greater than or equal to 20 mass %, even more preferably greater than or equal to 25 mass %, even more preferably greater than or equal to 30 mass %, even more preferably greater than or equal to 40 mass %, even more preferably greater than or equal to 45 mass % of a Group II base stock, based on the total mass of the oil of lubricating viscosity. Most preferably, the oil of lubricating viscosity consists essentially of a Group II base stock, that is the oil of lubricating viscosity comprises greater than 50 mass %, preferably greater than or equal to 60 mass %, more preferably greater than or equal to 70 mass %, even more preferably greater than or equal to 80 mass %, even more preferably greater than or equal to 90 mass % of a Group II base stock, based on the total mass of the oil of lubricating viscosity. The Group II base stock may be the sole oil of lubricating viscosity in the lubricating oil composition.

Definitions for the base stocks and base oils in this invention are the same as those found in the American Petroleum Institute (API) publication "Engine Oil Licensing and Certification System", Industry Services Department, Fourteenth Edition, December 1996, Addendum 1, December 1998. Said publication categorizes base stocks as follows:

a) Group I base stocks contain less than 90 percent saturates and/or greater than 0.03 percent sulphur and have a viscosity index greater than or equal to 80 and less than 120 using the test methods specified in Table E-1.

b) Group II base stocks contain greater than or equal to 90 percent saturates and less than or equal to 0.03 percent sulphur and have a viscosity index greater than or equal to 80 and less than 120 using the test methods specified in Table E-1.

c) Group III base stocks contain greater than or equal to 90 percent saturates and less than or equal to 0.03 percent sulphur and have a viscosity index greater than or equal to 120 using the test methods specified in Table E-1.

d) Group IV base stocks are polyalphaolefins (PAO).

e) Group V base stocks include all other base stocks not included in Group I, II, III, or IV.

TABLE E-1

Analytical Methods for Base Stock

| Property | Test Method |
|---|---|
| Saturates | ASTM D 2007 |
| Viscosity Index | ASTM D 2270 |
| Sulphur | ASTM D 2622 |
| | ASTM D 4294 |
| | ASTM D 4927 |
| | ASTM D 3120 |

Other oils of lubricating viscosity which may be included in the lubricating oil composition are detailed as follows:

Natural oils which include animal oils and vegetable oils (e.g., castor oil, lard oil); liquid petroleum oils and hydrorefined, solvent-treated or acid-treated mineral oils of the paraffinic, naphthenic and mixed paraffinic-naphthenic types. Oils of lubricating viscosity derived from coal or shale also serve as useful base oils.

Synthetic lubricating oils which include hydrocarbon oils and halo-substituted hydrocarbon oils such as polymerized and interpolymerized olefins (e.g., polybutylenes, polypropylenes, propylene-isobutylene copolymers, chlorinated polybutylenes, poly(1-hexenes), poly(1-octenes), poly(1-decenes)); alkylbenzenes (e.g., dodecylbenzenes, tetradecylbenzenes, dinonylbenzenes, di(2-ethylhexyl)benzenes); polyphenyls (e.g., biphenyls, terphenyls, alkylated polyphenols); and alkylated diphenyl ethers and alkylated diphenyl sulphides and derivative, analogs and homologs thereof.

Alkylene oxide polymers and interpolymers and derivatives thereof where the terminal hydroxyl groups have been modified by esterification, etherification, etc., constitute another class of known synthetic lubricating oils. These are exemplified by polyoxyalkylene polymers prepared by polymerization of ethylene oxide or propylene oxide, and the alkyl and aryl ethers of polyoxyalkylene polymers (e.g., methyl-polyiso-propylene glycol ether having a molecular weight of 1000 or diphenyl ether of poly-ethylene glycol having a molecular weight of 1000 to 1500); and mono- and polycarboxylic esters thereof, for example, the acetic acid esters, mixed $C_3$-$C_8$ fatty acid esters and $C_{13}$ Oxo acid diester of tetraethylene glycol.

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids) with a variety of alcohols (e.g., butyl alcohol, hexyl alcohol, dodecyl alcohol, 2-ethylhexyl alcohol, ethylene glycol, diethylene glycol monoether, propylene glycol). Specific examples of such esters includes dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols and polyol esters such as neopentyl glycol, trimethylolpropane, pentaerythritol, dipentaerythritol and tripentaerythritol.

Silicon-based oils such as the polyalkyl-, polyaryl-, polyalkoxy- or polyaryloxysilicone oils and silicate oils comprise another useful class of synthetic lubricants; such oils include tetraethyl silicate, tetraisopropyl silicate, tetra-(2-ethylhexyl)

silicate, tetra-(4-methyl-2-ethylhexyl)silicate, tetra-(p-tert-butyl-phenyl)silicate, hexa-(4-methyl-2-ethylhexyl)disiloxane, poly(methyl)siloxanes and poly(methylphenyl) siloxanes. Other synthetic lubricating oils include liquid esters of phosphorous-containing acids (e.g., tricresyl phosphate, trioctyl phosphate, diethyl ester of decylphosphonic acid) and polymeric tetrahydrofurans.

Unrefined, refined and re-refined oils can be used in lubricants of the present invention. Unrefined oils are those obtained directly from a natural or synthetic source without further purification treatment. For example, a shale oil obtained directly from retorting operations; petroleum oil obtained directly from distillation; or ester oil obtained directly from an esterification and used without further treatment would be an unrefined oil. Refined oils are similar to unrefined oils except that the oil is further treated in one or more purification steps to improve one or more properties. Many such purification techniques, such as distillation, solvent extraction, acid or base extraction, filtration and percolation are known to those skilled in the art. Re-refined oils are obtained by processes similar to those used to provide refined oils but begin with oil that has already been used in service. Such re-refined oils are also known as reclaimed or reprocessed oils and are often subjected to additionally processing using techniques for removing spent additives and oil breakdown products.

The oil of lubricating viscosity may also comprise a Group I, Group III, Group IV or Group V base stocks or base oil blends of the aforementioned base stocks. Preferably, the oil of lubricating viscosity includes a Group III, Group IV or Group V base stock, or a mixture thereof, in addition to the Group II base stock. Preferably, the volatility of the oil of lubricating viscosity or oil blend, as measured by the NOACK test (ASTM D5880), is less than or equal to 13.5%, preferably less than or equal to 12%, more preferably less than or equal to 10%, most preferably less than or equal to 8%. Suitably, when the oil of lubricating viscosity includes a Group III, Group IV or Group V base stock, or a mixture thereof, in addition to the Group II base stock, the viscosity index (VI) of the oil of lubricating viscosity is at least 120, preferably at least 125, most preferably from about 130 to 140.

The oil of lubricating viscosity is provided in a major amount, in combination with a minor amount of the salicylate detergent system and, if necessary, one or more co-additives, such as described hereinafter, constituting a lubricating oil composition. This preparation may be accomplished by adding the salicylate detergent system directly to the oil or by adding it in the form of a concentrate thereof to disperse or dissolve the additive. Additives may be added to the oil by any method known to those skilled in the art, either before, at the same time as, or after addition of other additives.

Suitably, the oil of lubricating viscosity is present in an amount of greater than 55 mass %, more preferably greater than 60 mass %, even more preferably greater than 65 mass %, based on the total mass of the lubricating oil composition. Preferably, the oil of lubricating viscosity is present in an amount of less than 98 mass %, more preferably less than 95 mass %, even more preferably less than 90 mass %, based on the total mass of the lubricating oil composition.

The lubricating oil composition may be used to lubricate mechanical engine components, particularly marine cylinder and trunk piston engines.

The lubricating oil compositions of the invention comprise defined components that may or may not remain the same chemically before and after mixing with an oleaginous carrier. This invention encompasses compositions which comprise the defined components before mixing, or after mixing, or both before and after mixing.

When concentrates are used to make the lubricating oil compositions, they may for example be diluted with 3 to 100, e.g. 5 to 40, parts by mass of oil of lubricating viscosity per part by mass of the concentrate.

Salicylate Detergent System (B)

A detergent is an additive that reduces formation of piston deposits, for example high-temperature varnish and lacquer deposits, in engines; it normally has acid-neutralising properties and is capable of keeping finely divided solids in suspension. Most detergents are based on metal "soaps"; that is metal salts of acidic organic compounds, sometimes referred to as surfactants.

Detergents generally comprise a polar head with a long hydrophobic tail, the polar head comprising a metal salt of an acidic organic compound. Large amounts of a metal base can be included by reacting an excess of a metal base, such as an oxide or hydroxide, with an acidic gas such as carbon dioxide to give an overbased detergent which comprises neutralised detergent as the outer layer of a metal base (e.g. carbonate) micelle.

The salicylate detergent system of the lubricating oil composition of the present invention comprises one or more neutral or overbased alkaline earth metal $C_{22}$ hydrocarbyl substituted salicylates. The one or more neutral or overbased alkaline earth metal $C_{22}$ hydrocarbyl substituted salicylates typically comprise one or more compounds of Formula I:

I

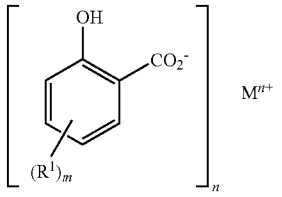

wherein $R^1$ represents a hydrocarbyl group having 22 carbon atoms, M is a alkaline earth metal, n is an integer of 1 or 2 depending on the valence of the alkaline earth metal, and m is an integer of 1 to 3.

Preferably, the alkaline earth metal M of the one or more neutral or overbased metal $C_{22}$ hydrocarbyl substituted salicylates of Formula I is an alkaline earth metal selected from calcium, magnesium, barium or strontium. More preferably, the metal M of the one or more neutral or overbased metal $C_{22}$ hydrocarbyl substituted salicylates is calcium or magnesium; calcium is especially preferred.

Preferably, the hydrocarbyl group consists solely of carbon and hydrogen atoms. The hydrocarbyl group may be predominantly aliphatic in nature and it is preferably purely aliphatic. Purely aliphatic hydrocarbyl groups include linear or branched aliphatic groups, for example linear or branched alkyl or alkenyl groups. Most preferably, the hydrocarbyl group represents a linear or branched alkyl group, particularly an unsubstituted linear or branched alkyl group, especially an unsubstituted linear alkyl group.

The $C_{22}$ hydrocarbyl group of the one or more neutral or overbased alkaline earth metal $C_{22}$ hydrocarbyl substituted salicylates which $R^1$ represents in one or more compounds of Formula I is preferably a linear or branched alkyl group, especially an unsubstituted linear or branched alkyl group. More preferably, the $C_{22}$ hydrocarbyl group comprises an unsubstituted linear (i.e. straight chain) alkyl group.

The $C_{22}$ alkyl group which the $C_{22}$ hyrdocarbyl group may represent may be a primary, secondary or tertiary alkyl group depending on the point of attachment of the alkyl group to the hydroxybenzoate ring in the compound of Formula I. Preferably, the $C_{22}$ hydrocarbyl group comprises a primary or secondary alkyl group, more preferably an unsubstituted linear primary or secondary alkyl group. By the term 'linear primary alkyl group' we mean a straight chain alkyl group which is attached via the carbon atom at the C-1 position of the alkyl chain to the hydroxybenzoate ring in the compound of Formula I, and the carbon atom at the C-1 position of the alkyl chain includes two hydrogen atoms and a single linear alkyl group bonded thereto. By the term 'linear secondary alkyl group' we mean a straight chain alkyl group which is attached via a carbon atom at a position other than the C-1 position of the alkyl chain to the hydroxybenzoate ring in the compound of Formula I, and the carbon atom at the point of attachment of the alkyl chain includes two linear alkyl groups and a single hydrogen atom bonded thereto.

According to a preferred embodiment, the $C_{22}$ hydrocarbyl group is predominantly a $C_{22}$ primary alkyl group, especially predominantly an unsubstituted linear $C_{22}$ primary alkyl group. By the term "predominantly" in this context we mean that greater than 50 mol %, more preferably greater than 55 mol %, of the $C_{22}$ alkyl groups in the one or more compounds of Formula I are primary alkyl groups, i.e. greater than 50 mol % of the alkyl groups are attached by the C-1 position of the alkyl group to the one or more hydroxybenzoate rings in the compound of Formula I.

The $C_{22}$ hydrocarbyl group which $R^1$ represents in a compound of Formula I may be in the ortho, meta or para position with respect to the hydroxyl group. Preferably, the $C_{22}$ hydrocarbyl group in a compound of Formula I is in the ortho or para position with respect to the hydroxyl group. When the $C_{22}$ hydrocarbyl group is in the ortho position with respect to the hydroxyl group in a compound of Formula I this represents a neutral or overbased alkaline earth metal 3-subsituted $C_{22}$ hydrocarbyl salicylate; when the $C_{22}$ hydrocarbyl group is in the para position with respect to the hydroxyl group in a compound of Formula I this represents a neutral or overbased alkaline earth metal 5-substituted $C_{22}$ hydrocarbyl salicylate.

Preferably, the one or more neutral or overbased alkaline earth metal $C_{22}$ hydrocarbyl substituted salicylates comprises one or more neutral or overbased alkaline earth metal mono-substituted $C_{22}$ hydrocarbyl salicylates, i.e. m represents 1 in a compound of Formula I. More preferably, the one or more neutral or overbased alkaline earth metal $C_{22}$ hydrocarbyl substituted salicylates comprises one or more 3-mono-substituted $C_{22}$ hydrocarbyl salicylates, one or more 5-mono-substituted $C_{22}$ hydrocarbyl salicylates, or a mixture thereof.

Preferably, the one or more neutral or overbased alkaline earth metal $C_{22}$ hydrocarbyl substituted salicylates comprises greater than 65% by mol, more preferably greater than 70% by mol, even more preferably greater than 80% by mol, even more preferably greater than 85% by mol, most preferably greater than 90% by mol of one or more neutral or overbased alkaline earth metal mono-substituted $C_{22}$ hydrocarbyl salicylates, preferably a mixture of the one or more 3-mono-substituted $C_{22}$ hydrocarbyl salicylates and one or more 5-mono-substituted $C_{22}$ hydrocarbyl salicylates, based on the total number of moles of the one or more neutral or overbased alkaline earth metal $C_{22}$ hydrocarbyl substituted salicylates present in the salicylate detergent system.

Preferably, the molar ratio of the one or more 3-mono-substituted $C_{22}$ hydrocarbyl salicylates to the one or more 5-mono-subsituted $C_{22}$ hydrocarbyl salicylates present in the one or more neutral or overbased alkaline earth metal $C_{22}$ hydrocarbyl substituted salicylates is greater than or equal to 1.2, more preferably greater than or equal to 1.5, even more preferably greater than or equal to 1.8, even more preferably greater than or equal to 2.0.

Preferably, the one or more neutral or overbased alkaline earth metal $C_{22}$ hydrocarbyl substituted salicylates comprises, preferably consists essentially of, one or more neutral or low based alkaline earth metal $C_{22}$ hydrocarbyl substituted salicylates. The term "overbased" is generally used to describe metal detergents in which the ratio of the number of equivalents of the metal moiety to the number of equivalents of the acid moiety is greater than one. Suitably, the term "neutral" is generally used to describe metal detergents in which the ratio of the number of equivalents of the metal moiety to the number of equivalents of the acid moiety is equal to one. The term "low based" is typically used to describe metal detergents in which the equivalent ratio of metal moiety to acid moiety is greater than 1 and up to about 2. Preferably, the one or more neutral or overbased alkaline earth metal $C_{22}$ substituted salicylates is neutral.

Suitably, the term "one or more neutral or overbased calcium $C_{22}$ substituted salicylates" is meant a neutral or overbased detergent in which the cations of the oil-insoluble alkaline earth metal salt are essentially calcium cations. Small amounts of other cations may be present in the oil-insoluble alkaline earth metal salt, but typically at least 80, more typically at least 90, for example at least 95, mole %, of the cations in the oil-insoluble alkaline earth metal salt, are calcium ions. Cations other than calcium may be derived, for example, from the use in the manufacture of the overbased detergent of a surfactant salt in which the cation is a metal other than calcium. Preferably, the metal salt of the surfactant is also calcium. Suitably, the terms "one or more neutral or overbased alkaline earth metal $C_{20}$ to $C_{30}$ substituted salicylates" and "one or more neutral or overbased calcium metal $C_{20}$ to $C_{30}$ substituted salicylates" are to be construed accordingly, as described above.

Carbonated overbased metal detergents typically comprise amorphous nanoparticles. Additionally, there are disclosures of nanoparticulate materials comprising carbonate in the crystalline calcite and vaterite forms.

It will be appreciated that other metal hydrocarbyl substituted salicylates, apart from the one or more neutral or overbased metal $C_{22}$ hydrocarbyl substituted salicylates, may be present in the salicylate detergent system. Unexpectedly, it has been found that if the other metal hydrocarbyl substituted salicylates present in the detergent system include longer chain hydrocarbyl groups (i.e. $C_{20}$ to $C_{30}$ hydrocarbyl groups) rather than shorter chain hydrocarbyl groups (i.e. $C_{10}$ to $C_{18}$ hydrocarbyl groups) this typically improves asphaltene dispersion performance.

Suitably, the salicylate detergent system, in addition to the one or more neutral or overbased alkaline earth metal $C_{22}$ hydrocarbyl substituted salicylates, includes one or more other neutral or overbased alkaline earth metal $C_{20}$ to $C_{30}$ hydrocarbyl substituted salicylates. The one or more other neutral or overbased alkaline earth metal $C_{20}$ to $C_{30}$ hydrocarbyl substituted salicylates typically comprise one or more compounds of Formula I, as depicted hereinbefore, wherein $R^1$ represents a hydrocarbyl group having 20 to 30 carbon atoms, and M, n and m are as defined hereinbefore. Preferably, the salicylate detergent system consists essentially of one or more neutral overbased $C_{20}$ to $C_{30}$ hydrocarbyl substituted salicylates, preferably $C_{20}$ to $C_{26}$ hydrocarbyl substituted salicylates, most preferably $C_{20}$ to $C_{24}$ hydrocarbyl substituted salicylates. That is, the salicylate detergent system comprises greater than 50 mol %, preferably greater than or equal to 60 mol %, more preferably greater than or equal to 65 mol %, even more preferably greater than or equal to 70 mol %, even more preferably greater than or equal to 75 mol %, even more preferably greater than or equal to 80 mol %, even more preferably greater than or equal to 85 mol %, most preferably greater than or equal to 90 mol % of one or more one or more neutral or overbased alkaline earth metal $C_{20}$ to $C_{30}$ hydrocarbyl substituted salicylates. For the avoidance of doubt, the one or more neutral or overbased alkaline earth metal $C_{20}$ to $C_{30}$ hydrocarbyl substituted salicylates include the one or more neutral or overbased alkaline earth metal $C_{22}$ hydrocarbyl substituted salicylates as defined herein. Moreover, the preferred features of the one or more neutral or overbased alkaline earth metal $C_{22}$ hydrocarbyl substituted salicylates (e.g. M, n and m in a compound of Formula I) also represent preferred features of the one or more other neutral or overbased alkaline earth metal $C_{20}$ to $C_{30}$ hydrocarbyl substituted salicylates. Suitably, the one or more neutral or overbased alkaline earth metal $C_{20}$ to $C_{30}$ hydrocarbyl substituted salicylates is neutral or low based, preferably neutral.

Preferably, the one or more neutral or overbased alkaline earth metal $C_{22}$ hydrocarbyl substituted salicylates is present in an amount of greater than or equal to 10% by mol, preferably greater than or equal to 17% by mol, even more preferably greater than or equal to 20% by mol, even more preferably greater than or equal to 25% by mol, even more preferably greater than or equal to 33% by mol, even more preferably greater than or equal to 40% by mol based on the total number of moles of the one or more neutral or overbased metal $C_{20}$ to $C_{30}$ hydrocarbyl substituted salicylates present in the salicylate detergent system.

In a preferred embodiment, the one or more neutral or overbased alkaline earth metal $C_{22}$ hydrocarbyl substituted salicylates is the predominant one or more neutral or overbased alkaline earth metal hydrocarbyl substituted salicylate species present in the salicylate detergent system. In other words, the number of moles of the one or more neutral or overbased alkaline earth metal $C_{22}$ hydrocarbyl substituted salicylates in the salicylate detergent system exceeds the number of moles of each of the other one or more neutral or overbased alkaline earth metal hydrocarbyl substituted salicylates present in the salicylate detergent system.

In a further preferred embodiment, the salicylate detergent system comprises greater than or equal to 50% by mol of the one or more neutral or overbased alkaline earth metal $C_{22}$ hydrocarbyl substituted salicylates.

Preferably, the one or more neutral or overbased alkaline earth metal $C_{20}$ to $C_{30}$ hydrocarbyl substituted salicylates comprises a $C_{20}$, $C_{22}$, $C_{24}$, $C_{26}$, $C_{28}$ or $C_{30}$ hydrocarbyl substituted salicylates or mixtures thereof.

The basicity of detergents is preferably expressed as a total base number (TBN). A total base number is the amount of acid needed to neutralise all of the basicity of the material. The TBN may be measured using ASTM standard D2896 or an equivalent procedure. The one or more neutral or overbased alkaline earth metal $C_{20}$ to $C_{30}$ hydrocarbyl substituted salicylates, including the one or more neutral or overbased alkaline earth metal $C_{22}$ hydrocarbyl substituted salicylates, may have a low TBN (i.e. a TBN of less than 50), a medium TBN (i.e. a TBN of 50 to 150) or a high TBN (i.e. a TBN of greater than 150 e.g. 150 to 500). Preferably, the one or more neutral or overbased alkaline earth metal $C_{22}$ hydrocarbyl substituted salicylates have a TBN up to 150, preferably 50 to 150. Preferably, the one or more other neutral or overbased alkaline earth metal $C_{20}$ to $C_{30}$ hydrocarbyl substituted salicylates have a TBN up to 150, preferably 50 to 150. Preferably, the salicylate detergent system has a TBN of up to 150, preferably 50 to 150. Suitably, the salicylate detergent system comprises a low based or neutral detergent system.

The basicity index of the one or more neutral or overbased alkaline earth metal $C_{20}$ to $C_{30}$ hydrocarbyl substituted salicylates, including the neutral or overbased alkaline earth metal $C_{22}$ hydrocarbyl substituted salicylates, is preferably greater than 1.0 and preferably less than 1.5.

By "basicity index" we mean the molar ratio of total base to total soap in a neutral or overbased detergent. A neutral detergent has a basicity index of 1.0. Suitably, the salicylate detergent system has a basicity index of greater than 1.0 and preferably less than 1.5.

Although the lubricating composition may include other metal detergents apart from the salicylate detergent system, for example metal phenate detergents, preferably the salicylate detergent system is the predominant detergent system in the lubricating oil composition. In other words, the salicylate detergent system contributes greater than 50%, preferably greater than 60%, more preferably greater than 70%, even more preferably greater than 80%, most preferably 90% of the total TBN to the lubricating oil composition. In a preferred embodiment, the salicylate detergent system is essentially the sole metal detergent system of the lubricating oil composition.

Suitably, the salicylate detergent system is present in an amount of 0.1 to 10 mass %, active ingredient, based on the total mass of the lubricating oil composition.

Salicylic acids are typically prepared by the carboxylation, by the Kolbe-Schmitt process, of phenoxides, and in that case, will generally be obtained (normally in a diluent) in admixture with uncarboxylated phenol. Salicylic acids may be non-sulphurized or sulphurized, and may be chemically modified and/or contain additional substituents. Processes for sulphurizing a hydrocarbyl-substituted salicylic acid are well known to those skilled in the art, and are described, for example, in US 2007/0027057.

In general, neutral metal hydrocarbyl-substituted salicylates can be prepared by neutralisation of hydrocarbyl-substituted salicylic acid with an equivalent quantity of metallic base. However, a preferred method of preparing a neutral calcium salt of salicylic acid is through double decomposition of methanolic solutions of calcium chloride and sodium hydroxide in the presence of hydrocarbyl-substituted salicylic acid, followed by removal of solids and process solvents.

Overbased metal hydrocarbyl-substituted salicylates can be prepared by any of the techniques employed in the art. A general method is as follows:

1. Neutralisation of hydrocarbyl-substituted salicylic acid with molar excess of metallic base to produce a slightly overbased metal hydrocarbyl-substituted salicylate complex, in a solvent mixture consisting of a volatile hydrocarbon, an alcohol and water;
2. Optionally, carbonation to produce colloidally dispersed metal carbonate followed by post-reaction period;
3. Removal of residual solids that are not colloidally dispersed; and
4. Stripping to remove process solvents.

Overbased metal hydrocarbyl-substituted salicylates can be made by either a batch or a continuous overbasing process.

To obtain a neutral or overbased alkaline earth metal hydrocarbyl-substituted salicylate detergent having a basicity index of less than 2, the quantity of metallic base is restricted to no more than 2 equivalents per equivalent of acid, and/or, if desired, the quantity of carbon dioxide is restricted to no more than 0.5 equivalents per equivalent of acid. Preferably, the quantity of metallic base is restricted to no more than 1.5 equivalents per equivalent of acid, and/or, if desired, the quantity of carbon dioxide is restricted to no more than 0.2 equivalents per equivalent of acid. More preferably, the quantity of metallic base is restricted to no more than 1.4 equivalents per equivalent of acid.

Alternatively, an excess of both metallic base and carbon dioxide can be used, provided that unreacted solids are removed before the carbonation step. In this case the basicity index will not exceed about 1.5. If an overbased metal hydrocarbyl-substituted salicylate detergent having a basicity index of less than 1.5 is required, it is not essential to use any carbon dioxide, but it is preferred. However, most preferably the metal hydrocarbyl-substituted salicylate detergent has a basicity index of less than or equal to 1.5.

As carbonation proceeds, dissolved hydroxide is converted into colloidal carbonate particles dispersed in the mixture of volatile hydrocarbon solvent and non-volatile hydrocarbon oil.

Carbonation may by effected over a range of temperatures up to the reflux temperature of the alcohol promoters.

The volatile hydrocarbon solvent of the reaction mixture is preferably a normally liquid aromatic hydrocarbon having a boiling point not greater than about 150° C. Aromatic hydrocarbons have been found to offer certain benefits, e.g. improved filtration rates, and examples of suitable solvents are toluene, xylene, and ethyl benzene.

The alkanol is preferably methanol although other alcohols such as ethanol can be used. Correct choice of the ratio of alkanol to hydrocarbon solvents, and the water content of the initial reaction mixture, are important to obtain the desired product.

Oil may be added to the reaction mixture; if so, suitable oils include hydrocarbon oils, particularly those of mineral origin. Oils which have viscosities of 15 to 30 cSt at 38° C. are very suitable.

After the reaction with metallic base, the reaction mixture is typically heated to an elevated temperature, e.g. above 130° C., to remove volatile materials (water and any remaining alkanol and hydrocarbon solvent). When the synthesis is complete, the raw product is hazy as a result of the presence of suspended sediments. It is clarified by, for example, filtration or centrifugation. These measures may be used before, or at an intermediate point, or after carbonation and solvent removal.

The products are generally used as an oil solution. If there is insufficient oil present in the reaction mixture to retain an oil solution after removal of the volatiles, further oil should be added. This may occur before, or at an intermediate point, or after solvent removal.

Additional materials may form an integral part of an overbased metal detergent. These may, for example, include long chain aliphatic mono- or di-carboxylic acids. Suitable carboxylic acids included stearic and oleic acids, and polyisobutylene (PIB) succinic acids.

Co-Additives

The lubricating oil composition may include at least one other co-additive, in addition to the salicylate detergent system (B), selected from friction modifiers, antiwear agents, dispersants, oxidation inhibitors, viscosity modifiers, pour point depressants, rust inhibitors, corrosion inhibitors, demulsifying components and foam control agents. Suitably, such one or more co-additives are present in a minor amount of the lubricating oil composition. Preferably, the one or more co-additives are present in an amount of 5 to 25, more preferably 5 to 18, typically 7 to 15, mass % of the lubricating oil composition.

Friction modifiers include glyceryl monoesters of higher fatty acids, for example, glyceryl mono-oleate; esters of long chain polycarboxylic acids with diols, for example, the butane diol ester of a dimerized unsaturated fatty acid; oxazoline compounds; and alkoxylated alkyl-substituted monoamines, diamines and alkyl ether amines, for example, ethoxylated tallow amine and ethoxylated tallow ether amine.

Other known friction modifiers comprise oil-soluble organo-molybdenum compounds. Such organo-molybdenum friction modifiers also provide antioxidant and antiwear credits to a lubricating oil composition. Suitable oil-soluble organo-molybdenum compounds have a molybdenum-sulfur core. As examples there may be mentioned dithiocarbamates, dithiophosphates, dithiophosphinates, xanthates, thioxanthates, sulfides, and mixtures thereof. Particularly preferred are molybdenum dithiocarbamates, dialkyldithiophosphates, alkyl xanthates and alkylthioxanthates. The molybdenum compound is dinuclear or trinuclear.

One class of preferred organo-molybdenun compounds useful in all aspects of the present invention is tri-nuclear molybdenum compounds of the formula $MO_3S_kL_nQ_z$ and mixtures thereof wherein L are independently selected ligands having organo groups with a sufficient number of carbon atoms to render the compounds soluble or dispersible in the oil, n is from 1 to 4, k varies from 4 through to 7, Q is selected from the group of neutral electron donating compounds such as water, amines, alcohols, phosphines, and ethers, and z ranges from 0 to 5 and includes non-stoichiometric values. At least 21 total carbon atoms should be present among all the ligands' organo groups, such as at least 25, at least 30, or at least 35 carbon atoms.

The molybdenum compounds may be present in a lubricating oil composition at a concentration in the range 0.1 to 2 mass %, or providing at least 10 such as 50 to 2,000 ppm by mass of molybdenum atoms.

Preferably, the molybdenum from the molybdenum compound is present in an amount of from 10 to 1500, such as 20 to 1000, more preferably 30 to 750, ppm based on the total weight of the lubricating oil composition. For some applications, the molybdenum is present in an amount of greater than 500 ppm.

Other detergents, apart from the salicylate detergent system, which may be present in the lubricating oil composition include neutral and overbased metal salts of oil-soluble sulfonates, phenates, sulfurized phenates, thiophosphonates, naphthenates and other oil-soluble carboxylates of a metal, particularly the alkali or alkaline earth metals, e.g. sodium, potassium, lithium, calcium and magnesium. The most commonly used metals are calcium and magnesium, which may both be present in detergents used in a lubricant, and mixtures of calcium and/or magnesium with sodium.

Dihydrocarbyl dithiophosphate metal salts are frequently used as antiwear and antioxidant agents. The metal may be an alkali or alkaline earth metal, or aluminum, lead, tin, molybdenum, manganese, nickel or copper. The zinc salts are most commonly used in lubricating oils in amounts of 0.1 to 10, preferably 0.2 to 2 wt. %, based upon the total weight of the lubricating oil composition. They may be prepared in accordance with known techniques by first forming a dihydrocarbyl dithiophosphoric acid (DDPA), usually by reaction of one or more alcohol or a phenol 10 mole %, is a non-conjugated diene, such as a $C_3$ to $C_{22}$ non-conjugated diolefin (for example, a copolymer of isobutylene and butadiene, or a copolymer of ethylene, propylene and 1,4-hexadiene or 5-ethylidene-2-norbornene). Preferred are polyisobutenyl (Mn 400-2500, preferably 950-2200) succinimide dispersants. Preferably, heavy duty diesel (HDD) engine lubricating oil compositions of the present invention contain an amount of a nitrogen-containing dispersant introducing from about 0.08 to about 0.25 mass %, preferably from about 0.09 to about 0.18 mass %, more preferably from about 0.10 to about 0.15 mass %, of nitrogen into the composition.

Oxidation inhibitors or antioxidants increase the resistance of the composition to oxidation and may work by combining with and modifying peroxides to render them harmless, by decomposing peroxides, or by rendering an oxidation catalyst inert. Oxidative deterioration can be evidenced by sludge in the lubricant, varnish-like deposits on the metal surfaces, and by viscosity growth.

They may be classified as radical scavengers (e.g. sterically hindered phenols, secondary aromatic amines, and organo-copper salts); hydroperoxide decomposers (e.g., organosulphur and organophosphorus additives); and multifunctionals (e.g. zinc dihydrocarbyl dithiophosphates, which may also function as anti-wear additives, and organo-molybdenum compounds, which may also function as friction modifiers and anti-wear additives).

Examples of suitable antioxidants are selected from copper-containing antioxidants, sulphur-containing antioxidants, aromatic amine-containing antioxidants, hindered phenolic antioxidants, dithiophosphates derivatives, metal thiocarbamates, and molybdenum-containing compounds. The amount of any such oil-soluble aromatic amine-containing antioxidant should preferably not exceed 0.4 wt. % active ingredient.

Viscosity modifiers (VM) or viscosity index improvers impart high and low temperature operability to a lubricating oil. Viscosity modifiers that also function as dispersants are also known and may be prepared as described above for ashless dispersants. In general, these dispersant viscosity modifiers are functionalised polymers (e.g. interpolymers of ethylene-propylene post grafted with an active monomer such as maleic anhydride) which are then derivatised with, for example, an alcohol or amine. with $P_2S_5$ and then neutralizing the formed DDPA with a zinc compound. For example, a dithiophosphoric acid may be made by reacting mixtures of primary and secondary alcohols. Alternatively, multiple dithiophosphoric acids can be prepared where the hydrocarbyl groups on one are entirely secondary in character and the hydrocarbyl groups on the others are entirely primary in character. To make the zinc salt, any basic or neutral zinc compound could be used but the oxides, hydroxides and carbonates are most generally employed. Commercial additives frequently contain an excess of zinc due to the use of an excess of the basic zinc compound in the neutralization reaction.

Examples of ashless anti-wear agents include 1,2,3-triazoles, benzotriazoles, thiadiazoles, sulfurised fatty acid esters, and dithiocarbarnate derivatives.

Ashless dispersants maintain in suspension oil insolubles resulting from oxidation of the oil during wear or combustion. They are particularly advantageous for preventing the precipitation of sludge and the formation of varnish, particularly in gasoline engines. Ashless dispersants comprise an oil soluble polymeric hydrocarbon backbone bearing one or more functional groups that are capable of associating with particles to be dispersed. Typically, the polymer backbone is functionalized by amine, alcohol, amide, or ester polar moieties, often via a bridging group. The ashless dispersant may be, for example, selected from oil soluble salts, esters, amino-esters, amides, imides, and oxazolines of long chain hydrocarbon substituted mono and dicarboxylic acids or their anhydrides; thiocarboxylate derivatives of long chain hydrocarbons; long chain aliphatic hydrocarbons having a polyamine attached directly thereto; and Mannich condensation products formed by condensing a long chain substituted phenol with formaldehyde and polyalkylene polyamine.

The oil soluble polymeric hydrocarbon backbone of these dispersants is typically derived from an olefin polymer or polyene, especially polymers comprising a major molar amount (i.e., greater than 50 mole %) of a $C_2$ to $C_{18}$ olefin (e.g., ethylene, propylene, butylene, isobutylene, pentene, octene-1, styrene), and typically a $C_2$ to $C_5$ olefin. The oil soluble polymeric hydrocarbon backbone may be a homopolymer (e.g., polypropylene or polyisobutylene) or a copolymer of two or more of such olefins (e.g., copolymers of ethylene and an alpha-olefin such as propylene or butylene, or copolymers of two different alpha-olefins). Other copolymers include those in which a minor molar amount of the copolymer monomers, for example, 1 to The lubricant may be formulated with or without a conventional viscosity modifier and with or without a dispersant viscosity modifier. Suitable compounds for use as viscosity modifiers are generally high molecular weight hydrocarbon polymers, including polyesters. Oil-soluble viscosity modifying polymers generally have weight average molecular weights of from 10,000 to 1,000,000, preferably 20,000 to 500,000, which may be determined by gel permeation chromatography or by light scattering.

Pour point depressants, otherwise known as lube oil flow improvers (LOFI), lower the minimum temperature at which the fluid will flow or can be poured. Such additives are well known. Typical of those additives that improve the low temperature fluidity of the fluid are $C_8$ to $C_{18}$ dialkyl fumarate/vinyl acetate copolymers, and polymethacrylates.

Rust and corrosion inhibitors serve to protect surfaces against rust and/or corrosion. As rust inhibitors there may be mentioned non-ionic polyoxyalkylene polyols and esters thereof, polyoxyalkylene phenols, and anionic alkyl sulfonic acids.

A small amount of a demulsifying component may be used. A preferred demulsifying component is described in EP 0,330,522. It is obtained by reacting an alkylene oxide with an adduct obtained by reacting a bis-epoxide with a polyhydric alcohol. The demulsifier should be used at a level not exceeding 0.1 mass % active ingredient. A treat rate of 0.001 to 0.05 mass % active ingredient is convenient.

Foam control can be provided by many compounds including an antifoamant of the polysiloxane type, for example, silicone oil or polydimethyl siloxane.

It may be necessary to include an additive which maintains the stability of the viscosity of the blend. Thus, although polar group-containing additives achieve a suitably low viscosity in the pre-blending stage it has been observed that some compositions increase in viscosity when stored for prolonged periods. Additives which are effective in controlling this viscosity increase include the long chain hydrocarbons functionalized by reaction with mono- or dicarboxylic acids or anhydrides which are used in the preparation of the ashless dispersants as hereinbefore disclosed.

It is not unusual to add an additive to a lubricating oil, or additive concentrate, in a diluent, such that only a portion of the added weight represents an active ingredient (A.I.). For example, dispersant may be added together with an equal weight of diluent in which case the "additive" is 50% A.I. dispersant. On the other hand, detergents are conventionally formed in diluent to provide a specified TBN and are oftentimes not referred to on an A.I. basis. As used herein, the term mass percent (mass %), when applied to a detergent refers to the total amount of detergent and diluent unless otherwise indicated, and when applied to all other additive refers to the weight of active ingredient unless otherwise indicated.

The individual additives may be incorporated into a base stock in any convenient way. Thus, each of the components can be added directly to the base stock or base oil blend by dispersing or dissolving it in the base stock or base oil blend at the desired level of concentration. Such blending may occur at ambient temperature or at an elevated temperature. When lubricating compositions contain one or more of the above-mentioned additives, each additive is typically blended into the base oil in an amount that enables the additive to provide its desired function. Representative amounts of such additives, used in the lubricating oil composition, are listed below. All the values listed are stated as mass percent active ingredient.

| ADDITIVE | MASS % (Broad) | MASS % (Preferred) |
|---|---|---|
| Ashless Dispersant | 0.1-20 | 1-8 |
| Metal Detergents | 0.1-6 | 0.2-4 |
| Corrosion Inhibitor | 0-5 | 0-1.5 |
| Metal Dihydrocarbyl Dithiophosphate | 0.1-6 | 0.1-4 |
| Antioxidant | 0-5 | 0.01-1.5 |
| Pour Point Depressant | 0.01-5 | 0.01-1.5 |
| Antifoaming Agent | 0-5 | 0.001-0.15 |
| Supplemental Antiwear Agents | 0-0.5 | 0-0.2 |
| Friction Modifier | 0-5 | 0-1.5 |
| Viscosity Modifier | 0-6 | 0.01-4 |
| Basestock | Balance | Balance |

Preferably, all the additives except for the viscosity modifier and the pour point depressant are blended into a concentrate or additive package described herein as the additive package that is subsequently blended into base stock to make the finished lubricant. The concentrate will typically be formulated to contain the additive(s) in proper amounts to provide the desired concentration in the final formulation when the concentrate is combined with a predetermined amount of a base lubricant.

The concentrate is preferably made in accordance with the method described in U.S. Pat. No. 4,938,880. That patent describes making a pre-mix of ashless dispersant and metal detergents that is pre-blended at a temperature of at least about 100° C. Thereafter, the pre-mix is cooled to at least 85° C. and the additional components are added.

Crankcase Lubricating Oil Formulation

A crankcase lubricating oil formulation may employ from 2 to 25 mass %, preferably 4 to 20 mass %, and most preferably about 5 to 18 mass % of the concentrate or additive package with the remainder being base stock. Preferably the volatility of the final crankcase lubricating oil formulation, as measured by the Noack volatility test (ASTM D5880), is less than or equal to 15 mass %, preferably less than or equal to 13 mass %, more preferably less than or equal to 12 mass %, most preferably less than or equal to 10 mass %. Preferably, lubricating oil compositions of the present invention have a compositional TBN (using ASTM D4739) of less than about 10.5, such as between 7.5 and 10.5, preferably less than or equal to about 9.5, such as about 8.0 to about 9.5.

Marine Cylinder Lubricants

A marine cylinder lubricating oil formulation may employ from 10 to 35 mass %, preferably 13 to 30 mass %, and most preferably about 16 to 24 mass % of the concentrate or additive package with the remainder being base stock. Preferably, marine cylinder lubricating oil compositions have a compositional TBN (using ASTM D2896) of about 40 to 100, such as between 50 and 90.

Trunk Piston Engine Oils

A trunk piston engine oils may employ from 7 to 35 mass %, preferably 10 to 28 mass %, and most preferably about 12 to 24 mass % of the concentrate or additive package with the remainder being base stock. Preferably, the trunk piston engine oils have a compositional TBN (using ASTM D2896) of about 20 to 60, such as between 25 and 55.

EXAMPLES

The present invention is illustrated by, but in no way limited to, the following examples.

Example 1

Preparation of $C_{22}$ Ortho-Alkyl Phenol $Fe(acac)_3$ (iron acetylacetonate complex, 0.228 g) was weighed into a 100 mL 3-neck flask to which was added 1-bromododocosane (5.0 g), N-methyl pyrrolidinone (5.26 ml) and then THF (6 ml). The resulting solution was cooled to 0° C. and then a solution of the Grignard reagent (2-methoxyphenyl magnesium bromide (18.64 ml of a 1M solution in THF)) was added dropwise over two hours using a syringe pump. The reaction was allowed to stir overnight in an ice bath and then gradually warmed to room temperature. The contents of the reaction flask were then mixed with toluene and poured into a separating funnel. HCl solution (10% (v/v)) was then added to acidify the toluene. The upper toluene layer was then washed with water, the toluene filtered into a round-bottomed flask and the solvent stripped using a rotary evaporator.

HBr (0.82 mol, 54 mL) was added to a 1 liter 3-neck flask containing the anisole made in the previous step (30 g) and tributylhexadecylphosphonium bromide (9.65 g). The resulting stirred suspension was heated to 135° C. for 5 hours. The aqueous phase was extracted with toluene (2×100 ml), the combined toluene extracts were washed with brine (150 ml), dried with $MgSO_4$ and the solvent removed under vacuum to provide a brown solid. The resulting residue was purified by column chromatography ($SiO_2$, toluene) to afford the title compound as a solid.

Example 2

Preparation of $C_{22}$ Ortho-Alkyl Salicylic Acid 2.1 Phenation Step

The $C_{22}$ ortho-alkylphenol of Example 1 (33.78 g) was weighed into a 3 liter 3-necked boiling flask and xylene (1000 ml) added using a measuring funnel. The flask was set up for distillation and nitrogen was blanketed over the mixture at 400 $ml.min^{-1}$. Stirring was then started at approx. 300 rpm and the mixture heated with an oil bath set to 100° C. An aqueous sodium hydroxide solution (50%, 7.4 ml) was charged to a small pressure equalised addition funnel and a vacuum applied and increased until the xylene just started to distil over. The sodium hydroxide was then added dropwise to the xylene/alkylphenol mixture. Approx. 250 ml of the xylene/water mixture was distilled off under vacuum to ensure that all the water had been removed. After distillation the flask was allowed to cool to approx. 80° C.

2.2 Carboxylation Step

After cooling, the contents of the flask from step 2.1 above were transferred to a 2 liter autoclave. A 1 barg nitrogen gas cap was applied, stirring was started and increased to 550 rpm and the autoclave was heated to 138° C. When the autoclave reached 138° C., $CO_2$ was added, the pressure was increased to approx. 19 barg and held at that temperature and pressure for 4 hours. After 4 hours the autoclave was cooled to approx. 50° C. Stirring was stopped and the autoclave was turned off and left under pressure overnight. The following day the pressure in the autoclave was reduced to 2 barg and the mixture was ejected into a metal beaker. The mixture was transferred to a 3 liter 3-necked reaction vessel. The acid value of the reaction mixture was measured by titration to determine the NaOH charge for the second phenation.

2.3 Rephenation Step

The resulting product of the carboxylation step 2.2 (648.5 g) was charged into a 3 liter 3-necked boiling flask and the phenation step, as detailed in step 2.1 above, repeated employing an aqueous sodiurn hydroxide solution (50%, 3.15 ml) charge in the small pressure equalised addition funnel flask.

2.4 Recarboxylation and Acidification Step

The contents of the flask from the rephenation step 2.3 were transferred to a 2 liter autoclave. A 1 barg nitrogen gas cap was applied, stirring was started and increased to 550 rpm and the autoclave was heated to 138° C. When the autoclave reached 138° C., $CO_2$ was added, the pressure was increased to approx. 19 barg and held at temperature and pressure for 4 hours. After carboxylation the autoclave was cooled to approximately 50° C. Stirring was stopped and the autoclave was turned off and left under pressure overnight.

The following day the pressure in the autoclave was reduced to approx. 2 barg and the contents were ejected into a metal beaker and transferred to a 3 liter 3-necked boiling flask set up for reflux. Nitrogen was blanketed over the mixture at 200 ml/min, the mixture was stirred at 300 rpm and heated in an oil bath at 70° C. Sulphuric acid (500 ml of 14% (v/v)) was added to the mixture from a dropping funnel. After addition of the acid the mixture was left stirring for 3 hours. The heat and stirring were then turned off and the mixture was left overnight. The mixture was then heated to 70° C. with stirring. After 30 minutes the mixture was transferred into a separating funnel and the acid layer was run off and discarded.

The xylene layer was put back into the reaction flask and 250 ml of de-ionised water was added. The mixture was stirred at approximately 300 rpm and heated in an oil bath at 70° C. The mixture was stirred at this temperature for 1 hour, cooled to room temperature and 15 g of salt added. Separation of the layers was apparent after approx. 5 minutes. Stirring was stopped and the mixture poured into a separating funnel, brine added and the xylene layer collected. The xylene layer was run back into the reaction vessel and washed in the same manner with a further 250 ml of de-ionised water. This was separated by adding salt in the same manner. After separation the xylene layer was washed a third time with 250 ml de-ionised water in the same manner and left overnight. The layers had separated cleanly and the brine was run off and discarded. The xylene layer was dried over magnesium sulphate, the mixture filtered under gravity through a Whatman No. 2 filter, the filtrate transferred to a 2 liter pear-shaped flask and the solvent removed under vacuum at 125° C. The acid number was found to be 0.51 meq./g and the product consisted essentially of primary linear $C_{22}$ ortho-alkyl salicylic acid.

Example 3

Preparation of Low Base Calcium $C_{22}$ Ortho-Alkyl Salicylate

The $C_{22}$ ortho-alkyl salicylic acid of Example 2 was mixed with a commercial lower alkyl (i.e. less than $C_{20}$) salicylic acid (Infineum M7103, obtainable from Infineum UK Limited) on a 80:20 mol:mol basis (Example 2: commercial salicylic acid). The salicylic acid mixture (10.4 g) and xylene (76.3 g) were mixed together at room temperature. Calcium hydroxide (2.87 g) and further xylene (100 g) were added, nitrogen passed through the mixture (60 $ml.min^{-1}$) and the resulting mixture heated in an oil bath. When the mixture reached a temperature of 42.3° C., a promoter (methanol: water (97%:3%), 20.46 ml) was added and the resulting mixture stirred at 40.6° C. for 1 hour.

The mixture was then transferred to a centrifuge and spun at 1500 rpm for 1 hour. The supernatant liquid was transferred to a 3-necked flask and nitrogen passed through the mixture at 60 ml $min^{-1}$ with stirring at 400 rpm and heating to 54.3° C. Carbon dioxide was then passed through the mixture at 50 $ml.min^{-1}$ for 1 hour, and the nitrogen as before. The mixture was heated for 30 minutes at 55° C. and then centrifuged at 1500 rpm for 60 minutes as before. The xylene phase was decanted into a 0.5 liter pear-shaped flask that contained 4.0 grams of a Group I base oil (XOMAPE150, obtained from ExxonMobil), the xylene, and any residual methanol and water, were stripped off at 125° C. for 2 hours. The Basicity Index (BI) of the composition was measured as 1.26.

Example 4

Preparation of $C_{16}$ Ortho-Alkyl Phenol

The title compound was obtained as a solid using the procedure as outlined in Example 1 by employing 2-methoxyphenyl magnesium bromide (26.2 ml), $Fe(acac)_3$ (0.30 g), 1-bromohexadecane (5.17 g), N-methyl pyrrolidinone (2 ml) in tetrahydrofuran solution (20 ml).

Example 5

Preparation of $C_{16}$ Ortho-Alkyl Salicylic Acid

The title compound was prepared using the procedure as outlined in Example 2 employing: $C_{16}$ ortho-alkyl phenol of Example 4 (79.6 g) and aqueous sodium hydroxide solution (50%, 21.2 ml) in step 2.1; the product from the carboxylation step (832.9 g) and aqueous sodium hydroxide solution (50%, 9.79 ml) in step 2.3; and concentrated sulphuric acid (300 ml, 14% (v/v)) in step 2.4. The acid number after the second pass carboxylation was found to be 0.51 meq./g and the product consisted essentially of primary linear $C_{16}$ ortho-alkyl salicylic acid.

Example 6

Preparation of Low Base Calcium $C_{16}$ Ortho-Alkyl Salicylate

The title composition was prepared using the procedure as outlined in Example 3 employing: $C_{16}$ ortho-alkyl salicylic acid of Example 5 (5.50 g): commercial lower alkyl (i.e. less than $C_{20}$) salicylic acid (1.44 g, Infineum M7103, obtainable from Infineum UK Limited) on a 80:20 mol:mol basis, xylene (197.52 g), calcium hydroxide (2.50 g), a promoter of methanol:water (97%:3%, 22.90 ml), carbon dioxide (3 l) and Group I base stock (XOMAPE150, ExxonMobil, 4.0 g). The Basicity Index of the composition was measured as 1.26.

Example 7

Preparation of $C_{20}$-$C_{24}$ Alkyl Phenol

A linear $C_{20}$-$C_{22}$-$C_{24}$ α-olefin mixture (1302 g, Gulftene, obtainable from Chevron) was added to a melt of phenol (1753.3 g) at 55° C. in a 3 necked flask equipped with a condenser. The mixture was heated at 125° C. with stirring for 45 minutes, cooled to room temperature and a catalyst K5 (1.2%, 36.6 g, Sud Chemie) slowly added to the reaction mixture. A pressure of 0.45 bar was applied to the reaction mixture and the mixture heated to 190° C. after the initial exotherm had subsided. Heating was continued for 5 hours, the mixture cooled to 175° C., depressurised and left at room temperature overnight. Gas chromatography (8% sample in toluene) indicated the reaction had proceeded to completion with only a negligible amount of the α-olefin remaining. Diatomaceous earth (73.4 g, 2.4% by wt) was added to the mixture with stirring and the resulting mixture heated to 100° C. The hot product filtered through a high pressure bomb filter heated to 80° C. and the filtrate collected in a 4 liter flask. The title compound was obtained as a liquid (1598 g) by distillation of the filtrate under vacuum at a temperature of 75° C. to 150° C.

Example 8

Preparation of $C_{20}$-$C_{24}$ Alkyl Salicylic Acid

The title compound was prepared using the procedure as outlined in Example 2 employing: $C_{20}$-$C_{24}$ alkyl phenol of Example 7 (300 g) and aqueous sodium hydroxide solution (50%, 61.4 ml) in step 2.1; the product from the carboxylation step (600 g) and aqueous sodium hydroxide solution (50%, 25 ml) in step 2.3; and, concentrated sulphuric acid (114 g, 14% (v/v)) in step 2.4. The acid number of the final product was measured as 0.75 meq./g. The $C_{20}$-$C_{24}$ alkyl salicylic acid consisted essentially of (i.e. greater than 90 mol %) of mono-substituted $C_{20}$-$C_{24}$ alkyl salicylic acid comprising a mixture of 56% by mol ortho-mono-$C_{20}$-$C_{24}$ alkyl salicylic acid and 44% by mol para-mono-$C_{20}$-$C_{24}$ alkyl salicylic acid. The molar ratio of the respective $C_{20}$:$C_{22}$:$C_{24}$ alkyl salicylic acids in the $C_{20}$-$C_{24}$ alkyl salicylic acid was 2:2:1 by gas chromatography.

Example 9

Preparation of Low Base Calcium $C_{20}$-$C_{24}$ Alkyl Salicylate

The $C_{20-24}$ alkyl salicylic acid of Example 8 was charged into a 2 liter straight sided flask fitted with 2 baffles, to which was added calcium hydroxide (20 g) and xylene (138 g). The mixture was heated to 40° C., then 38.22 g of promoter (3% by volume water in methanol) was added and the temperature was held at 40° C. for 1 hour under nitrogen. The reactor contents were then centrifuged at 1500 rpm for 1 hour, and then the supernatant liquid returned to a clean 2 liter straight sided flask fitted with 2 baffles.

The mixture was heated to 55° C., and then carbonation was begun at 190 ml/min. The first signs of slow breakthrough were seen after 5 minutes. The $CO_2$ addition was complete after 1 hour with breakthrough occurring at the same rate as the addition. The reactants were held at 55° C. for 30 minutes before transferring the contents to the centrifuge.

The mixture was centrifuged at 1500 rpm for 1 hour. The thin top layer of methanol and water was removed, and then the xylene/salicylate layer was carefully poured off the sediment/lime layer. A Group I base oil (XOMAPE150, ExxonMobil, 50 ml) was added before stripping off the xylene under vacuum at 125° C. A Basicity Index of 1.39 and calcium content of 3.23% were determined.

Example 10

Preparation of $C_{14}$-$C_{18}$ Alkyl Salicylic Acid

The title compound was prepared using the procedure as outlined in Example 2, but not including the rephenation and recarboxylation steps, employing: a $C_{14}$-$C_{16}$-$C_{18}$ alkyl phenol mixture (500 g, IDN 2294, Infineum UK Ltd) and aqueous potassium hydroxide solution (50%, 194 ml) in step 2.1; and, concentrated sulphuric acid (187 g, diluted to 14% (v/v)) in the acidification step of step 2.4. The acid number was measured as 1.3 meq./g. The $C_{14}$-$C_{18}$ alkyl salicylic acid consisted essentially of (i.e. greater than 90 mol %) of 3 or 5 mono-substituted $C_{14}$-$C_{18}$ alkyl salicylic acid.

Example 11

Preparation of Low Base Calcium $C_{14}$-$C_{18}$ Alkyl Salicylate

The title composition was prepared using the procedure as described in Example 9 employing: $C_{14}$-$C_{18}$ alkyl salicylic acid of Example 10 (67 g); xylene (134 g); calcium hydroxide (11.75 g); promoter (22.37 g, 3% by volume in methanol); and Group I base oil (40 g, XOMAPE150). A Basicity Index of 1.42 and calcium content of 3.22% were determined.

Focused Beam Reflectance Method ('FBRM')

The metal salicylate detergents were tested for their asphaltene dispersancy using laser light scattering according to the Focused Beam Reflectance method ('FBRM'), which predicts asphaltene agglomeration and hence 'black sludge' formation. The FBRM test method was disclosed at the 7$^{th}$ International Symposium on Marine Engineering, Tokyo, 24-28 Oct. 2005, and was published in 'The Benefits of Salicylate Detergents in TPEO Applications with a Variety of Base Stocks', in the Conference Proceedings. Further details were disclosed at the CIMAC Congress, Vienna, 21-24 May 2007 and published in "Meeting the Challenge of New Base Fluids for the Lubrication of Medium Speed Marine Engines—An Additive Approach" in the Congress Proceedings. In the latter paper it is disclosed that by using the FBRM method it is possible to obtain quantitative results for asphaltene dispersancy that predict performance for lubricant systems based on both Group I and Group II base stocks. The predictions of relative performance obtained from FBRM were confirmed by engine tests in marine diesel engines.

The FBRM probe contains fibre optic cables through which laser light travels to reach the probe tip. At the tip an optic focuses the laser light to a small spot. The optic is rotated so that the focussed beam scans a circular path between the window of the probe and the sample. As particles flow past the window they intersect the scanning path, giving backscattered light from the individual particles.

The scanning laser beam travels much faster than the particles; this means that the particles are effectively stationary. As the focussed beam reaches one edge of the particle there is an increase in the amount of backscattered light; the amount will decrease when the focussed beam reaches the other edge of the particle.

The instrument measures the time of the increased backscatter. The time period of backscatter from one particle is multiplied by the scan speed and the result is a distance or chord length. A chord length is a straight line between any two points on the edge of a particle. This is represented as a chord length distribution, a graph of numbers of chord lengths (particles) measured as a function of the chord length dimensions in microns. As the measurements are performed in real time the statistics of a distribution can be calculated and tracked. FBRM typically measures tens of thousands of chords per second, resulting in a robust number-by-chord length distribution. The method gives an absolute measure of the particle size distribution of the asphaltene particles.

The Focused beam Reflectance Probe (FBRM), model Lasentec D600L, was supplied by Mettler Toledo, Leicester, UK. The instrument was used in a configuration to give a particle size resolution of 1 μm to 1 mm. Data from FBRM can be presented in several ways. Studies have suggested that the average counts per second can be used as a quantitative determination of asphaltene dispersancy. This value is a function of both the average size and level of agglomerate. In this application, the average count rate (over the entire size range) was monitored using a measurement time of 1 second per sample.

The metal salicylate detergents (10% w/w) and Chevron 600 RLOP Group II base stock were blended together for fifteen minutes whilst heating to 60° C. and stirring at 400 rpm; when the temperature reached 60° C. the FBRM probe was inserted into the sample and measurements made for 15 minutes. An aliquot of heavy fuel oil (10% w/w) was introduced into the lubricant formulation under stirring using a four blade stirrer (at 400 rpm). A value for the average counts per second was taken when the count rate had reached an equilibrium value (typically after 1 hour)

FBRM Test Results

| Example | Base Stock | Particle Counts, per s |
|---|---|---|
| Comparative A (base stock only) | Chevron 600 RLOP | 3345 |
| Example 3 ($C_{22}$ ortho-alkylsalicylate) | Chevron 600 RLOP | 65 |
| Example 6 ($C_{16}$ ortho-alkylsalicylate) | Chevron 600 RLOP | 297 |
| Example 9 ($C_{20}$-$C_{24}$ alkyl salicylates) | Chevron 600 RLOP | 158 |
| Example 11 ($C_{14}$-$C_{18}$ alkyl salicylates) | Chevron 600 RLOP | 345 |

As shown in the Table above, the calcium $C_{22}$ ortho-alkyl salicylate of Example 3 exhibits surprisingly lower average counts per second than the calcium $C_{16}$ ortho-alkyl salicylate of Example 6. Moreover, the calcium $C_{20}$-$C_{24}$ alkyl salicylates of Example 9 exhibit surprisingly lower average counts per second than the calcium $C_{16}$-$C_{18}$ alkyl salicylates of Example 11. The average counts value is a function of both the average size and the level of agglomerate. Suitably, the calcium $C_{22}$ ortho-alkyl salicylate is more than four times as efficient at dispersing asphaltenes in a Group II base stock than the calcium $C_{16}$ ortho-alkyl salicylate. The calcium $C_{20}$-$C_{24}$ alkyl salicylates are at least two times more efficient at dispersing asphaltenes than the calcium $C_{16}$-$C_{18}$ alkyl salicylates. Therefore, the use of a calcium $C_{22}$ ortho-alkyl salicylate, and calcium $C_{20}$-$C_{24}$ alkyl salicylates, improves asphaltene dispersancy.

What is claimed is:

1. A method of reducing asphaltene precipitation (black paint) in an engine, the method including the step of lubricating the engine with a lubricating oil composition comprising, or made by admixing:

(A) an oil of lubricating viscosity in a major amount; and (B) a salicylate detergent system in a minor amount comprising one or more neutral or overbased alkaline earth metal $C_{22}$ hydrocarbyl substituted salicylates; with the proviso that the salicylate detergent system does not include an alkali metal salicylate;

wherein the number of moles of the one or more neutral or overbased alkaline earth metal $C_{22}$ hydrocarbyl substituted salicylates in the salicylate detergent system exceeds the number of moles of each of any other one or more neutral or overbased alkaline earth metal hydrocarbyl substituted salicylates present in the salicylate detergent system.

2. The method as claimed in claim 1, wherein the salicylate detergent system consists essentially of one or more neutral or overbased alkaline earth metal $C_{22}$ hydrocarbyl substituted salicylates and, optionally, one or more other neutral or overbased alkaline earth metal $C_{20}$ to $C_{30}$ hydrocarbyl substituted salicylates.

3. The method as claimed in claim 1, wherein the oil of lubricating viscosity comprises a Group II base stock.

4. The method as claimed in claim 3, wherein the oil of lubricating viscosity preferably consists essentially of a Group II base stock.

5. The method as claimed in claim 1, wherein the one or more neutral or overbased alkaline earth metal $C_{22}$ hydrocarbyl substituted salicylates comprises one or more neutral or overbased metal mono-substituted $C_{22}$ hydrocarbyl salicylates.

6. The method as claimed in claim 5, wherein said one or more neutral or overbased metal mono-substituted $C_{22}$ hydrocarbyl salicylates comprises a 3-mono-substituted $C_{22}$ hydrocarbyl salicylate, a 5-mono-substituted $C_{22}$ hydrocarbyl salicylate, or a mixture thereof.

7. The method as claimed in claim 2, wherein said one or more neutral or overbased alkaline earth metal $C_{22}$ hydrocarbyl substituted salicylates is present in an amount of greater than or equal to 10% by mol, based on the total number of moles of said one or more neutral or overbased metal $C_{20}$ to $C_{30}$ hydrocarbyl substituted salicylates present in the salicylate detergent system.

8. The method as claimed in claim 7, wherein said one or more neutral or overbased alkaline earth metal $C_{22}$ hydrocarbyl substituted salicylates is present in an amount of greater than or equal to 15% by mol, based on the total number of moles of said one or more neutral or overbased alkaline earth metal $C_{22}$ hydrocarbyl substituted salicylates and, optionally, one or more other one or more neutral or overbased metal $C_{20}$ to $C_{30}$ hydrocarbyl substituted salicylates present in the salicylate detergent system.

9. The method as claimed in claim 1, wherein the salicylate detergent system is essentially the sole detergent system present in the lubricating oil composition.

10. The method as claimed in claim 2, wherein said salicylate detergent system consists essentially of one or more neutral or overbased alkaline earth metal $C_{22}$ hydrocarbyl substituted salicylates and one or more other neutral or overbased alkaline earth $C_{20}$, $C_{24}$, $C_{26}$, $C_{28}$ or $C_{30}$ hydrocarbyl substituted salicylate.

11. The method as claimed in claim 2, wherein said salicylate detergent system consists essentially of one or more neutral or overbased alkaline earth metal $C_{22}$ hydrocarbyl substituted salicylates and one or more other neutral or overbased alkaline earth metal $C_{20}$ to $C_{26}$ hydrocarbyl substituted salicylates.

12. The method as claimed in claim 11, wherein said salicylate detergent system consists essentially of one or more neutral or overbased alkaline earth metal $C_{22}$ hydrocarbyl substituted salicylates and one or more other overbased alkaline earth metal $C_{20}$ to $C_{24}$ hydrocarbyl substituted salicylates.

13. The method as claimed in claim 2, wherein the hydrocarbyl group in said one or more neutral or overbased alkaline earth metal $C_{22}$ hydrocarbyl substituted salicylates and, one or more other neutral or overbased alkaline earth metal $C_{20}$ to $C_{30}$ hydrocarbyl substituted salicylates comprises an alkyl group.

14. The method as claimed in claim 13, wherein said alkyl group is a straight chain alkyl group.

15. The method as claimed in claim 13, wherein said alkyl group is predominantly a primary alkyl group.

16. The method as claimed in claim 15, wherein said primary alkyl group is a primary straight chain alkyl group.

17. The method as claimed in claim 1, wherein the $C_{22}$ hydrocarbyl group in said one or more neutral or overbased alkaline earth metal $C_{22}$ hydrocarbyl substituted salicylates comprises a $C_{22}$ alkyl group.

18. The method as claimed in claim 17, wherein said $C_{22}$ alkyl group is a straight chain $C_{22}$ alkyl group.

19. The method as claimed in claim 18, wherein the $C_{22}$ alkyl group which the $C_{22}$ hydrocarbyl group in said one or more neutral or overbased alkaline earth metal $C_{22}$ hydrocarbyl substituted salicylates may represent is predominantly a $C_{22}$ primary alkyl group.

20. The method as claimed in claim 19, wherein said $C_{22}$ primary alkyl group is a straight chain $C_{22}$ primary alkyl group.

21. The method as claimed in claim 1, wherein said one or more neutral or overbased alkaline earth metal $C_{22}$ hydrocarbyl substituted salicylates comprises greater than 65% by mol of a mixture of 3-mono-substituted $C_{22}$ hydrocarbyl salicylate and 5-mono-substituted $C_{22}$ hydrocarbyl salicylate, based on the total number of moles of said one or more neutral or overbased metal $C_{22}$ hydrocarbyl substituted salicylates present in said salicylate detergent system.

22. The method as claimed in claim 6, wherein the molar ratio of said 3-mono-substituted $C_{22}$ hydrocarbyl salicylate to said 5-mono-substituted $C_{22}$ hydrocarbyl salicylate present in said one or more neutral or overbased alkaline earth metal $C_{22}$ hydrocarbyl substituted salicylates is greater than equal to 1.2.

23. The method as claimed in claim 22, wherein the molar ratio of said 3-mono-substituted $C_{22}$ hydrocarbyl salicylate to said 5-mono-substituted $C_{22}$ hydrocarbyl salicylate present in said one or more neutral or overbased alkaline earth metal $C_{22}$ hydrocarbyl substituted salicylates is greater than equal to 1.5.

24. The method as claimed in claim 23, wherein the molar ratio of said 3-mono-substituted $C_{22}$ hydrocarbyl salicylate to said 5-mono-substituted $C_{22}$ hydrocarbyl salicylate present in said one or more neutral or overbased alkaline earth metal $C_{22}$ hydrocarbyl substituted salicylates is greater than equal to 1.8.

25. The method as claimed in claim 1, wherein the metal is calcium.

26. The method as claimed in claim 1, wherein the lubricating oil composition further comprising one or more co-additives in a minor amount, other than the detergent system (b), selected from friction modifiers, antiwear agents, dispersants, oxidation inhibitors, viscosity modifiers, pour point depressants, rust inhibitors, corrosion inhibitors, demulsifiers and foam control agents.

27. The method as claimed in claim 1, wherein the lubricating oil composition is a trunk piston engine oil.

* * * * *